United States Patent [19]

Svoboda

[11] Patent Number: 4,544,177

[45] Date of Patent: Oct. 1, 1985

[54] SKI BRAKE

[75] Inventor: Josef Svoboda, Schwechat, Austria

[73] Assignee: TMC Corporation, Baar, Switzerland

[21] Appl. No.: 414,701

[22] Filed: Sep. 3, 1982

[30] Foreign Application Priority Data

Sep. 18, 1981 [AT] Austria ..... 4044/81

[51] Int. Cl.[4] ..... A63C 7/10

[52] U.S. Cl. ..... 280/605

[58] Field of Search ..... 780/605, 12 AB; 188/5, 188/7

[56] References Cited

U.S. PATENT DOCUMENTS

| | | | |
|---|---|---|---|
| 4,101,145 | 7/1978 | Korgor | 280/605 |
| 4,266,802 | 5/1981 | Svoboda | 280/605 |
| 4,268,060 | 5/1981 | Svoboda | 280/605 |
| 4,278,268 | 7/1981 | Szasz | 280/605 |
| 4,366,968 | 1/1983 | Klubitschko | 280/605 |
| 4,371,187 | 2/1983 | Svoboda et al. | 280/605 |
| 4,386,788 | 6/1983 | Krob | 280/605 |

FOREIGN PATENT DOCUMENTS

| | | | |
|---|---|---|---|
| WO80/01651 | 8/1980 | PCT Int'l Appl. | 280/605 |

*Primary Examiner*—David M. Mitchell

*Attorney, Agent, or Firm*—Flynn, Thiel, Boutell & Tanis

[57] ABSTRACT

A ski brake includes a holding plate mountable on a ski, a first pedal part having one end supported on the holding plate for pivotal movement about a stationary first axle and the other end pivotally coupled to one end of a second pedal part. The other end of the second pedal part is pivotally supported on a second axle which extends normal to and is supported for movement parallel to the longitudinal axis of the ski. A helical spring has one end supported on the first axle and the other end supported on the second axle and urges the second axle to move in a direction parallel to the longitudinal axis of the ski. Two braking arms are rotationally supported on the second pedal part, are rotationally biased by torsion springs, and have extensions engageable with surfaces on the holding plate to effect rotation of the braking arms in response to movement of the second pedal part.

6 Claims, 3 Drawing Figures

SKI BRAKE

FIELD OF THE INVENTION

This invention relates to a ski brake and, more particularly to a ski brake having two braking arms which are preferably made of a multiply bent wire material, have one wire section which extends parallel to the longitudinal axis of the ski, are supported in one part of a pedal which has at least two parts, and can be swung in and out by means of an extension, the two pedal parts being pivotally connected and, with the braking arms, forming a braking mechanism, the pedal part which supports the braking arms being supported for pivotal movement and for sliding movement against the force of a spring on a swivel axle which extends normal to the longitudinal axis of the ski and is slidably guided in a slide bearing which extends in the direction of the longitudinal axis of the ski and is supported on a ski-fixed holding plate.

BACKGROUND OF THE INVENTION

A ski brake of the abovementioned type is disclosed, for example, in German OS No. 30 38 018, in particular in FIGS. 1 and 2. (German OS No. 30 38 018 corresponds to U.S. patent application Ser. No. 200,121, filed Oct. 24, 1980 and entitled SKI BRAKE now U.S. Pat. No. 4,371,187). In this construction, the pedal part which supports respective braking arm sections of the two braking arms is a braking arm carrier which at one one end is pivotally connected to a swivel axis which is supported for sliding motion and, at the other end, is pivotally connected to one end of a second pedal part which is constructed as a stepping plate. The stepping plate is pivotally connected to a ski-fixed axle by means of a bar which is pivotally supported on the other end of the stepping plate. In this manner, the braking mechanism is formed by a four-joint system which not only has many structural parts, but also requires the use of several springs for satisfactory swivelling of the braking mechanism from the retracted position to the braking position, namely at least one spring which biases the braking-arm carrier and at least one further spring which biases the bar. Also, this ski brake permits the designer to choose the braking angle, namely the angle between the braking mandrels and the upper side of the ski in the braking position, only within a limited range.

The subject matter of the present application is also related to that disclosed in U.S. patent application Ser. No. 234 226, filed Feb. 13, 1981 and entitled SKI BRAKE (now U.S. Pat. No. 4,386,788).

German OS No. 29 02 703 discloses a ski brake, the braking arms of which are supported by bearing blocks which are arranged pivotally about a ski-fixed axle. To operate the two braking arms, a pedal is provided which is pivotal about a further ski-fixed axle. The pedal has two guideways on its underside, into which project cams of the braking arms. Furthermore, the pedal has an extension which projects into the area below its swivel axle, on which extension is supported one end of an erecting spring which is a tension spring. The other end of the tension spring is suspended on a round rod which is held on the two bearing blocks. Since control of the swivelling movement of the braking arms occurs, during a stepping down on the pedal, directly through engagement of the cams on the braking arms with the pedal, high frictional forces must be overcome between the pedal and the cams of the braking arms. A further disadvantage of this ski brake is that it has a relatively large structural height, due to the mentioned spring fastening and the use of the bearing blocks.

Therefore, a purpose of the invention is to design a ski brake of the abovementioned type which is simple and has few structural parts, and in which the braking angle which exists in the braking position can be chosen within a large range.

SUMMARY OF THE INVENTION

This purpose is attained inventively by the second part of the pedal, which part is free of the braking arms, being supported on a ski-fixed axle which extends substantially at a right angle to the longitudinal axis of the ski, on which axle is supported one end of the spring which biases the braking mechanism and which preferably is an expansion spring which extends in the direction of the longitudinal axis of the ski.

The inventive measures assure a ski brake which is simple and has few structural parts. Since the part of the pedal which is free of braking arm sections is pivotally supported on a ski-fixed axle, a type of toggle joint is formed with the other pedal part, which is pivotally connected to the mentioned pedal part and is guided movably in the slide bearing. The toggle joint permits the designer to select the braking angle of the braking arms within a relatively large range. Fastening one end of the spring on the ski-fixed axle contributes substantially to the compact structure of the ski brake.

In one inventive embodiment, the part of the two-part pedal which supports sections of the two braking arms is a stepping plate which can be engaged by a ski shoe and the second part of the pedal, which is free of the braking arms is constructed as a guide plate, a guide bar or the like which, viewed in the braking position of the ski brake, defines an acute angle $\alpha$ with the upper side of the ski. Depending on the selection of the size of the angle $\alpha$, it is not only possible to adjust the braking angle, but comfortable operation of the braking mechanism can also be assured.

A further embodiment of the invention is characterized by the part of the pedal which is free of braking arm sections being a stepping plate which can be engaged by a ski shoe, and by the other part of the pedal, which supports sections of the two braking arms, being constructed as a guide plate which, in the braking position of the ski brake, defines an obtuse angle $\beta$ with the upper side of the ski, the spring being a compression spring. This arrangement produces a particularly compact design of the ski brake, since both the guide plate and also the stepping plate are arranged to pivot in the same direction.

BRIEF DESCRIPTION OF THE DRAWINGS

Further details, advantages and characteristics of the invention will now be described in greater detail in connection with two exemplary embodiments of the inventive ski brake.

In the drawings.

DETAILED DESCRIPTION

Figure 1:
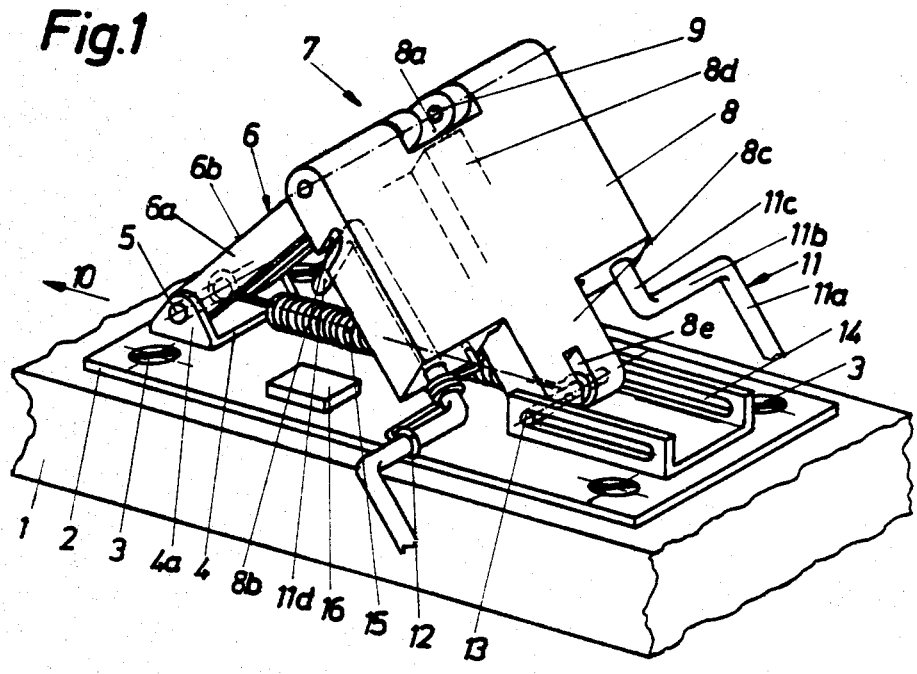
FIG. 1 is a perspective view of a first exemplary embodiment of an inventive ski brake in a braking position.

As can be seen from FIG. 1, a rectangular holding plate 2 is secured on a ski 1 by screws 3. The holding plate 2 carries at its end nearest the tip of the ski a support 4 which includes two spaced holding plates 4*a* arranged symmetrically with respect to the longitudinal axis of the ski 1. Extending between the two holding plates 4*a* is an axle or bolt 5, on which is pivotally supported one part 6 of a two-part pedal 7, which part 6 is constructed as a guide plate, guide bar or the like. The guide plate 6 includes a cover plate 6*b* and also two side arms 6*a* which extend parallel to the longitudinal axis of the ski in the retracted position of the brake and are pivotally supported on the axle 5. The cover plate 6*b* is supported on the side arms 6*a*, terminates with these laterally, and extends substantially the entire length thereof. The ends of the side arms 6*a* which are remote from the axle 5 project into a recess 8*a* provided at one end of the second pedal part, which is a stepping plate 8. The guide plate 6 is pivotally coupled to the stepping plate 8 by means of two bolts 9 which are aligned with one another. The adjacent ends of the guide plate 6 and the stepping plate 8 are provided with rounded surfaces which are concentric with the bolts 9.

The stepping plate 8 has, in this exemplary embodiment, a width which is approximately three times that of the cover plate 6*b* of the guide plate 6, and has near its end which is adjacent the guide plate 6 two groove-like recesses 8*b* which are arranged in the underside of the stepping plate 8, are symmetric with respect to the longitudinal axis of the stepping plate, and extend through the sidewalls of the stepping plate 8. These recesses 8*b* receive respective extensions or bent end sections 11*d* of two braking arms 11. In the braking position of the ski brake, each end section 11*d* extends at a small acute angle with respect to the upper side of the ski 1. A braking arm section 11*c* is connected to each end section 11*d*, extends at a right angle thereto, is supported rotatably in the stepping plate 8, and extends approximately parallel to the longitudinal axis of the ski 1 in the retracted position of the braking mechanism. The braking arm sections 11*c* extend downwardly out of the stepping plate 8, and each braking arm 11 is then bent two more times. The first bend is spaced from the stepping plate 8 a sufficient distance to permit a torsion spring 12 to be supported on the braking arm section 11*c*. One end of the spring 12 is supported on or secured to the stepping plate 8, and the other end is supported on or secured to the braking arm section 11*b* which follows the bend. The braking arm section 11*b* extends, in the braking position of the ski brake, at a right angle to the longitudinal axis of the ski 1 and projects laterally beyond the side surfaces of the ski. A further bend at the end of the braking arm section 11*b* connects it to a braking arm section 11*a* which extends parallel to the braking arm section 11*c*. The free end of braking arm section 11*a*, which is not illustrated, serves as a braking mandrel and carries in a conventional manner a braking blade or the like.

A platelike extension 8*c* is provided on the stepping plate 8 at the end thereof which is adjacent the holding plate 2 in the braking position of the ski brake. The extension 8*c* has, extending through it, a swivel axle 13 which is arranged substantially at a right angle to the longitudinal axis of the ski 1.

The ends of the swivel axle 13 are slidably supported in holding plate-fixed slide bearings 14 which have slots extending parallel to the longitudinal axis of the ski 1. The stepping plate 8 is thus slidably and pivotally supported in the slide bearings 14.

The platelike extension 8*c* of the stepping plate 8 is provided with a recess or slot 8*e* in the region of the swivel axle 13, which recess receives one end of a helical expansion spring 15, which end is supported on the swivel axle 13.

Figure 2:
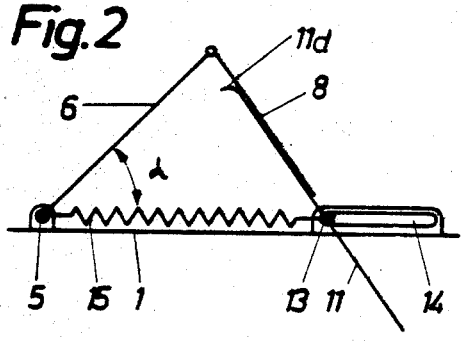
FIG. 2 is a diagrammatic side view of the ski brake of FIG. 1 in the braking position.

In the braking position of the ski brake, the spring 15 and the two torsion springs 12 are at least partially relaxed or unbiased. In this position of the ski brake, the guide plate 6 defines, with respect to the upper side of the ski 1, an acute angle $\alpha$ (FIG. 2).

If a not illustrated ski shoe now acts onto the stepping plate 8, then the guide plate 6 pivots downwardly about the axle 5, and the stepping plate 8 pivots relative to the guide plate 6 about the two bolts 9 against the force of the tension spring 15 to the retracted position and pivots about swivel axle 13, which slides in the slide bearing 14. The lower end of the stepping plate 8 thus slides by means of the swivel axle 13 in a direction opposite the direction of the arrow 10 in FIG. 1, and the bent end sections 11*d* of the two braking arms 11 engage the upper sides of stops 16 which are provided on the holding plate 2. By completely stepping down on the pedal 7, each end section 11*d* slides on the associated stop 16, causing a swivelling of the end section 11*d* and thus of the associated braking arm 11 through an angle of approximately 90°. In the retracted position of the ski brake, the sections 11*a* of the braking arms 11 are thus positioned above the upper side of the ski 1 and between the planes of the ski sides. The torsion springs 12 and the expansion spring 15 are tensioned in the retracted position of the ski brake. The stops 16 are, in this position of the ski brake, received in correspondingly designed and not illustrated recesses in the underside of the stepping plate 8, and the spring 15 is received between the side arms 6*a* of the guide plate 6 and in a further recess 8*d* provided in the underside of the stepping plate 8.

Figure 3:
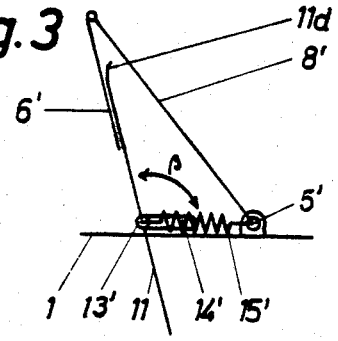
FIG. 3 is a diagrammatic side view similar to FIG. 2 of a second exemplary embodiment of the inventive ski brake in the braking position.

The guide plate 6' in the embodiment of FIG. 3 has its lower end slidably supported by ski-fixed slide bearings 14'. The design of the guide plate 6' corresponds approximately with that of the stepping plate 8 of the first exemplary embodiment. Thus, the braking arm section 11*c* of each of the two braking arms 11 is rotatably supported in the guide plate 6'. The bent end sections 11*d* of each braking arm 11, viewed in the braking position of the ski brake, point toward the underside of the stepping plate 8' and are engaged by the underside of the stepping plate 8' during a swinging down of the braking mechanism, causing the braking arms 11 to be rotated through an angle of approximately 90° in the guide plate to a position in which the braking blades are above the upper side of the ski 1 and between the planes of the ski sides. The further details of the braking arms 11 and also the arrangement of the torsion springs thereon is the same as in the first exemplary embodiment. The stepping plate 8' of the exemplary embodiment of FIG. 3 is pivotally supported at one end on the guide plate 6' and at the other end on a ski-fixed axle 5'. The erecting spring is a helical compression spring 15' which extends in the longitudinal direction of the ski, has one end supported on the swivel axle 13' of the guide plate 6', which swivel axle 13' is guided for sliding motion in a slide bearing 14', and has its other end supported on the ski-fixed axle 5'. In the braking position of the ski brake, the guide plate 6' defines, with respect to the upper side of the ski 1, an obtuse angle $\beta$. The pressure spring 15', during swivelling of the braking mechanism from the retracted position to the braking position, moves the swivel axle 13' of the guide plate 6', which swivel axle 13' is guided for sliding motion in the slide bearings 14', in a direction away from the ski-fixed axis 5' and thus effects the swivelling of the braking mechanism into the braking position. In this position of the ski brake, the pressure spring 15' is preferably received in a correspondingly designed recess provided in the underside of the stepping plate 8'.

By suitably selecting the angle $\alpha$ or $\beta$ and the dimensions of the guide plate 6 or 6' and the stepping plate 8 or 8', the braking angle which exists in the braking position of the ski brake can be selected freely within a relatively wide range.

The invention is not limited to the illustrated exemplary embodiments. Modifications, including the rearrangement of parts, are conceivable without leaving the scope of the invention. Thus, it is possible to design the guide plate as a bar which is U-shaped in a top view. Also, it is possible to arrange several springs side-by-side. Furthermore, it is possible to replace the compression spring which is used in the second exemplary embodiment with one or more expansion springs suspended at one end on the swivel axle of the guide plate which is supported for sliding motion and at the other end on a support part which is secured in front of the ski brake. Of course, it is also possible to secure the ski brake on the upper side of the ski in such a manner that the braking mandrels point against the direction of travel. Finally, the entire ski brake can be supported for movement longitudinally of the ski by means of a base plate which is movably supported on a ski-fixed guide rail and can be releasably locked in desired positions therealong. Also, connection and common adjustment of the ski brake and a ski-binding part is conceivable. These features are known by themselves and therefore do not need any further discussion.

The embodiments of the invention in which an exclusive property or priviledge is claimed are defined as follows:

1. A ski brake, comprising a pedal having first and second parts, and a braking arm having a first section which extends parallel to a longitudinal axis of the ski, is rotatably supported on said first part of said pedal, and can be rotated by means which includes an extension provided on said braking arm, said pedal parts being pivotally connected with one another and forming, together with said braking arm, a braking mechanism, said first pedal part being supported for pivotal movement on a movably supported swivel axle which is biased by a spring, which extends substantially at a right angle with respect to the longitudinal axis of the ski, and which is slidably supported in a slide bearing, said slide bearing extending in the direction of the longitudinal axis of the ski and being supported by a ski-fixed holding plate, said second part of said pedal being pivotally supported on a ski-fixed axle which extends substantially at a right angle with respect to the longitudinal axis of the ski and which supports one end of said spring which biases said swivel axle; wherein said second pedal part includes two spaced, parallel arms and a cover plate thereon; wherein said first pedal part is substantially wider than said second pedal part, has a recess at one end in which ends of said spaced, parallel arms are pivotally supported, and has an extension at the other end through which said swivel axle guided in said slide bearing extends, said extension having a slot therein and an end of said spring extending into said slot; wherein said braking arm includes a second section which is generally parallel to and spaced radially from said first section, rotation of said frst section causing said second section to move between first and second positions in which it is respectively spaced laterally inwardly and outwardly of a side wall of the ski; and including a further spring which is cooperable with said braking arm and which yieldably urges rotation of said first section thereof in a direction corresponding to movement of said second section toward its second position.

2. The ski brake according to claim 1, wherein said first part of said pedal is a stepping plate which can be engaged by a ski shoe, and said cover plate of said second part of said pedal in a braking position of the ski brake, defines an acute angle with respect to a portion of the upper surface of the ski which is located between said axles.

3. The ski brake according to claim 1, wherein said cover plate of said second part of said pedal is a stepping plate which can be engaged by a ski shoe, wherein said first part of said pedal is a plate which, in a braking position of the ski brake, defines an obtuse angle with respect to a portion of the upper surface of the ski which is located between said axles, and wherein said spring is a compression spring.

4. The ski brake according to claim 3, wherein said extension on said braking arm extends generally radially of said first section thereof and has an end remote from said first section which slidably engages a surface on said second part of said pedal as said ski brake moves to a braking position.

5. The ski brake according to claim 2, wherein said spring is an extension spring, and wherein said extension on said braking arm extends generally radially of said first section thereof and has an end remote from said first section which slidably engages a surface on said holding plate as said ski brake moves to a braking position.

6. The ski brake according to claim 1, including two said braking arms, said first part of said pedal rotatably supporting said first section of each said braking arm.

* * * * *